US008291526B2

(12) United States Patent
Parvizian

(10) Patent No.: US 8,291,526 B2
(45) Date of Patent: Oct. 23, 2012

(54) PORTABLE AND ADJUSTABLE MULTIPURPOSE TOILET TRAINING DEVICE

(76) Inventor: Goli Parvizian, McLean, VA (US)

( * ) Notice: Subject to any disclaimer, the term of this patent is extended or adjusted under 35 U.S.C. 154(b) by 1132 days.

(21) Appl. No.: 12/000,058

(22) Filed: Dec. 7, 2007

(65) Prior Publication Data

US 2009/0145340 A1 Jun. 11, 2009

(51) Int. Cl.

| | |
|---|---|
| ***E03D 11/00*** | (2006.01) |
| ***A47K 3/024*** | (2006.01) |
| ***A47K 17/00*** | (2006.01) |
| ***A47C 16/00*** | (2006.01) |

(52) U.S. Cl. ..... 4/254; 4/571.1; 4/573.1; 4/661; 297/423.1

(58) Field of Classification Search ..... 4/638, 661, 4/254, 560.1–562.1, 571.1–575.1, 578.1, 4/579, 587, 480; 297/423.41, 423.45, 423.1; 108/42; 403/56, 57; 411/380, 396

See application file for complete search history.

(56) References Cited

U.S. PATENT DOCUMENTS

| | | | | |
|---|---|---|---|---|
| 180,881 | A * | 8/1876 | Howson | 403/56 |
| 2,243,264 | A * | 5/1941 | Stromblad | 4/254 |
| 2,550,797 | A * | 5/1951 | Friedman | 239/33 |
| 3,589,057 | A * | 6/1971 | Fechner | 446/86 |
| 4,125,656 | A | 11/1978 | Creamer | |
| 4,244,064 | A * | 1/1981 | Parr | 4/254 |
| D258,472 | S | 3/1981 | Adam | |
| 4,505,265 | A | 3/1985 | Cronenwett et al. | |
| 4,584,725 | A | 4/1986 | Oliver | |
| 4,713,846 | A | 12/1987 | Hodroski, Jr. | |
| 4,777,672 | A | 10/1988 | Gebhard et al. | |
| D307,629 | S | 5/1990 | Takahashi et al. | |
| 5,028,024 | A | 7/1991 | Welles | |
| 5,033,528 | A * | 7/1991 | Volcani | 160/351 |
| 5,097,542 | A * | 3/1992 | Roesler | 4/579 |
| 5,398,347 | A | 3/1995 | Luedtke et al. | |
| 5,524,295 | A | 6/1996 | Ford | |
| 5,535,975 | A * | 7/1996 | Scott | 248/346.01 |
| 5,833,418 | A * | 11/1998 | Shoji | 411/396 |
| 5,933,877 | A | 8/1999 | Wu | |
| 5,983,418 | A | 11/1999 | Goodman et al. | |
| 5,987,657 | A | 11/1999 | Byers | |
| 6,050,044 | A * | 4/2000 | McIntosh | 52/591.1 |
| 6,085,361 | A | 7/2000 | Whitaker | |
| 6,148,448 | A | 11/2000 | Urso | |
| 6,174,581 | B1 | 1/2001 | Barker | |
| 6,206,805 | B1 * | 3/2001 | Helton et al. | 482/52 |
| 6,265,084 | B1 | 7/2001 | Stickler | |
| 6,295,658 | B1 | 10/2001 | Jenkins | |
| 6,314,592 | B1 * | 11/2001 | Stein | 4/579 |

(Continued)

*Primary Examiner* — Gregory L. Huson
*Assistant Examiner* — Erin Deery
(74) *Attorney, Agent, or Firm* — Doster Greene, LLC

(57) ABSTRACT

A device for facilitating use of a bathroom fixture according to various exemplary embodiments can include at least a first planar body and a second planar body having a pair of opposed legs extending from each planar body defining a first opening and a second opening for receiving and conforming to a configuration of a base of a bathroom fixture. An interlocking element may be interposed between at least the first planar body and the second planar body for interlocking and stacking at least the first and second planar bodies to form a raised platform adjustable to a predetermined height based upon a user's height for facilitating use of the bathroom fixture according to the user's height. A skid-resistance bottom surface may be provided on either the first planar body or the second planar body for securing the raised platform to an underlying surface to prevent movement.

21 Claims, 11 Drawing Sheets

U.S. PATENT DOCUMENTS

| | | | | |
|---|---|---|---|---|
| 6,446,275 | B1 | 9/2002 | Wright et al. | |
| 6,631,524 | B1 | 10/2003 | Dixon | |
| 6,715,161 | B1 | 4/2004 | Depoe, Jr. | |
| 6,763,531 | B1 | 7/2004 | Huffman et al. | |
| D493,999 | S | 8/2004 | Ruhl et al. | |
| 6,787,210 | B2 | 9/2004 | Stickler | |
| 6,854,803 | B2 | 2/2005 | Tomas et al. | |
| 7,243,806 | B2 * | 7/2007 | Kwok | 211/105.3 |
| 2004/0221517 | A1 * | 11/2004 | Jirele | 52/6 |
| 2005/0022298 | A1 | 2/2005 | de Leon et al. | |
| 2005/0223488 | A1 | 10/2005 | Amorin | |

* cited by examiner

PORTABLE AND ADJUSTABLE MULTIPURPOSE TOILET TRAINING DEVICE

FIELD

The present teachings relate to devices and methods using a portable and adjustable supporting surface, such as, for example, a mat or a platform, for facilitating toilet or potty training for a toddler. The supporting surface can further be easily disassembled and quickly reassembled to assist a toddler with using another bathroom fixture, such as, for example, a sink or bathtub.

INTRODUCTION

Transitioning from diapers to learning to successfully use an adult toilet is an important stage of development for every toddler. However, the learning process can present several challenges for such a young individual and the adult caregiver. Teaching a toddler to use an adult toilet requires that the toddler feels secure and comfortable during the toilet training process.

Toddlers are more likely to successfully accomplish toilet training if they feel more secure about using the toilet and are able to maneuver themselves on and off the toilet easily any time they need to go and to stabilize themselves with their feet to push when they have a bowel movement. However, a toddler's size in comparison to an adult toilet may hinder the toddler's progress in using the toilet. The age and size of a toddler when an adult caregiver may begin the toilet training process may vary and depend upon many factors. Some adults prefer to have a toddler successfully toilet trained before the toddler reaches the age of one. While on the other hand, other toddlers may not be prepared to learn to use a toilet well into their fourth year. Regardless when toilet training is undertaken during the toddler stage, a toddler may feel overwhelmed and intimidated by the size of the adult toilet. For instance, while sitting on the adult toilet, the toddler may experience discomfort or insecurity due to the toddler's short legs which tend not to reach the floor and dangle unsupported. Thus, the toddler's legs are not stabilized and cannot aid the toddler with pushing to facilitate the toddler's bowel movement. Therefore, the toddler oftentimes will sit unsuccessfully upon the toilet for an extended time without having a bowel movement, which discourages the toddler and hinders his or her progress.

Another disadvantage associated with the toddler's size and height, especially for a male toddler, is obtaining control over the direction of his urine flow. The toddler will most likely encounter occasions when there are mishaps and misdirects his urine wetting the exterior or base of the toilet and the surrounding floor area. If the soiled items and areas are not cleaned and sanitized immediately or if these areas are frequently soiled during the toilet training process, a foul odor may eventually develop. Such mishaps can be attributed to the toddler's inexperience and his incorrect positioning due to his limited height in comparison to the adult toilet.

Numerous urinal mats and toilet training devices exist. In some cases, these devices are configured as flat mats that collect and chemically treat the spilled urine, but do not vertically adjust according to a toddler's size to facilitate toilet training. In some cases, the height of these toilet training devices can be adjustable, but these devices are bulky mechanical devices that physically attach to the toilet.

In addition to learning to use an adult toilet, a toddler may also be overwhelmed by the size of other adult bathroom fixtures, such as, a sink and a bathtub. Thus, the toddler may also need a step stool to use such facilities. Similar to the potty training device, such a step stool should provide the toddler with security and comfort during use. However, some of the existing toilet devices that abut to the base of a toilet are not capable of securely connecting to the base of a sink or a bathtub. Therefore, a caregiver may be required to purchase several different devices to assist a toddler to use several different bathroom fixtures within a single bathroom. The storage of these different devices can be cumbersome and untidy.

Furthermore, some toddler potty training devices and step stools are advertised as multipurpose devices allegedly having a wide application with several different bathroom fixtures. Oftentimes, such devices may be appropriate for a particular use with a specific bathroom fixture, but inappropriate for another use with another bathroom fixture because the device fails to provide the toddler with security and safety when using the other bathroom fixture. For example, some miniature potty training devices are advertised as being adjustable from a potty seat to a step stool. Such a device may be converted from a potty seat to the step stool by closing the lid so that the lid serves as a standing surface of the step stool. However, oftentimes when the toddler uses the device as a step stool, for example, with a sink to assist the toddler with washing his or her hands, the device may be unstable, wobble, shift or slide as the toddler steps upon, stands on and/or exits from the device. This instability is due to the fact that the device does not securely attach to the floor beneath and/or the bathroom fixture. Furthermore, in some cases, when the potty seat is converted to a step stool, the standing surface is inadequate and too small to permit the toddlers to comfortably stand upon and maneuver themselves during use. Although the caregiver is aware of these shortcomings of the device, the caregiver may reluctantly settle for using one device designed for a certain bathroom fixture that is inappropriate or unsafe for use with another bathroom fixture, because the caregiver is unable to find a more suitable multipurpose device.

It may be desirable to provide a supporting surface that offers security and comfort to a toddler during toilet training. It may also be desirable to assist a male toddler with properly orientating himself with respect to the toilet according to the size of the toddler. It may also be desirable to provide a supporting surface for assisting a toddler with toilet training, so as to avoid the use of mechanical equipment to physically attach the device to an adult bathroom fixture. It may also be desirable to provide a supporting surface that may accommodate various shaped bases of toilets, so that the supporting surface is capable of conforming to and fitting closely around the base of a toilet, even if the base of a toilet includes several different shapes. It may also be desirable to provide a supporting surface that is relatively simple in terms of design and implementation. For example, it may be desirable to provide a reusable and inexpensive supporting surface that is compact, portable and simple to clean and sanitize. It may also be desirable to provide a supporting surface that is easily convertible to securely attach to a variety of bathroom fixtures.

SUMMARY

The present invention may satisfy one or more of the above-mentioned desirable features. Other features and/or advantages may become apparent from the description which follows.

A device for facilitating use of a bathroom fixture according to various exemplary embodiments can include a plurality of planar bodies. At least a first planar body and a second planar body may include a pair of opposed legs extending from each planar body defining a first opening and a second opening for receiving and conforming to a configuration of a base of a bathroom fixture. An interlocking element may be interposed between at least the first planar body and the second planar body for interlocking and stacking at least the first and second planar bodies to form a raised platform adjustable to a predetermined height based upon a user's height for facilitating use of the bathroom fixture according to the user's height. A skid-resistance bottom surface may be provided on at least one of the first planar body and second planar body for securing the raised platform to an underlying surface to prevent movement.

A supporting surface for facilitating use of a bathroom fixture according to various exemplary embodiments can include a planar body. A detachable legs assembly may extend from the planar body defining an opening for receiving and conforming to a configuration of a base of a bathroom fixture.

A supporting surface for facilitating use of a bathroom fixture according to various exemplary embodiments can include a planar body. A detachable legs assembly may extend from the planar body for defining an opening for receiving and conforming to a configuration of a base of a bathroom fixture. At least one attachment mechanism may be extractable and retractable through at least one recess in the at least one detachable legs assembly for providing an attachment to a surface.

A kit for assembling a supporting surface to facilitate use of a bathroom fixture according to various exemplary embodiments can include at least a first planar body and a second planar body of a plurality of planar bodies. At least one detachable legs assembly may extend from at least one of the first planar body and the second planar body defining at least one opening for receiving and conforming to a configuration of a base of a bathroom fixture. An interlocking element may be interposed between at least the first planar body and the second planar body for interlocking and stacking together at least the first and second planar bodies for providing a supporting surface vertically adjustable to a predetermined height for facilitating use of the bathroom fixture.

A method of providing an adjustable supporting surface to facilitate use of a bathroom fixture can include providing a plurality of planar bodies; providing a first planar body; providing a second planar body; providing a detachable legs assembly attachable to and detachable from at least one of the first planar body and the second planar body, wherein the detachable legs assembly defines at least one opening for receiving and conforming to a configuration of a base of a bathroom fixture; interlocking and stacking at least the first planar body with the second planar body to provide a raised supporting surface; and positioning the interlocked and stacked raised supporting surface such that the at least one opening receives and conforms to the configuration of the base of the bathroom fixture to facilitate use of the bathroom fixture.

In the following description, certain aspects and embodiments will become evident. It should be understood that the invention, in its broadest sense, could be practiced without having one or more features of these aspects and embodiments. It should be understood that these aspects and embodiments are merely exemplary and explanatory and are not restrictive of the invention.

BRIEF DESCRIPTION OF THE DRAWINGS

The skilled artisan will understand that the drawings described below are for illustrative purposes only. The drawings are not intended to limit the scope of the present teachings in any way.

DETAILED DESCRIPTION OF VARIOUS EMBODIMENTS

Figure 1:
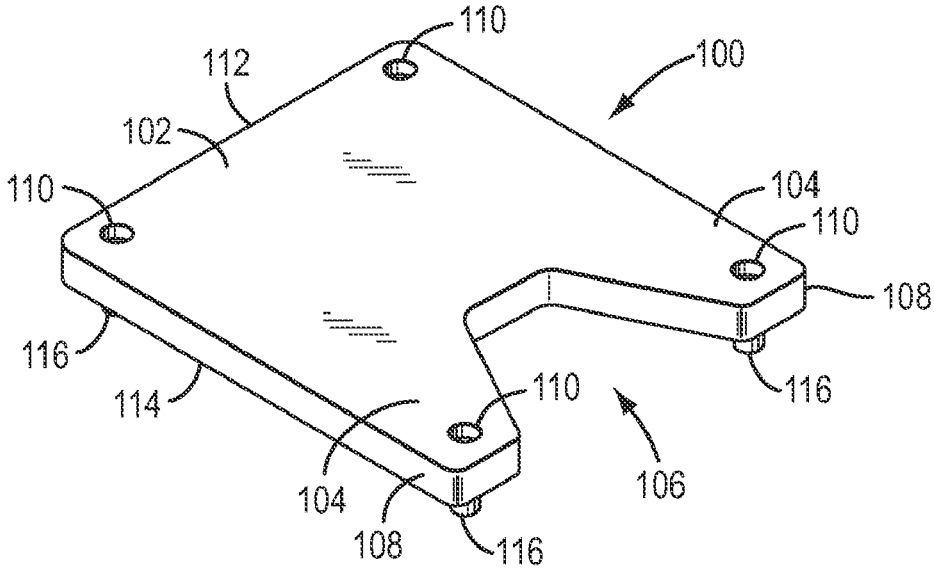
FIG. 1 is a perspective view of an exemplary embodiment of a toilet training device in accordance with the present teachings.

Reference will now be made to various embodiments, examples of which are illustrated in the accompanying drawings. However, these various exemplary embodiments are not intended to limit the disclosure. On the contrary, the disclosure is intended to cover alternatives, modifications, and equivalents.

Throughout the application, description of various embodiments may use "comprising" language, however, it will be understood by one of skill in the art, that in some specific instances, an embodiment can alternatively be described using the language "consisting essentially of" or "consisting of."

For purposes of better understanding the present teachings and in no way limiting the scope of the teachings, it will be clear to one of skill in the art that the use of the singular includes the plural unless specifically stated otherwise. Therefore, the terms "a," "an" and "at least one" are used interchangeably in this application.

Unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that may vary depending upon the desired properties sought to be obtained. In some instances, "about" can be understood to mean a given value ±5%. At the very least, each numerical parameter should at least be construed in light of the number of reported significant digits and by applying ordinary rounding techniques.

Various embodiments provide a toddler with a compact and portable supporting surface that is readily assembled and dissembled by the toddler's caregiver. In various embodiments, the supporting surface may be easily dissembled and stored in a compartment, such as, for example, a suitcase, for easily transporting the supporting surface during travel with a toddler for use, for example, in hotels or on family vacations.

Various embodiments provide a toddler with a vertically adjustable platform including at least two stackable supporting surfaces that securely interlock one with another. In various embodiments, the platform also firmly affixes to the floor or the underlying surface to prevent movement during use. Thus, the device offers a toddler security, comfort and reassurance during toilet training. Various embodiments assist a male toddler with properly orienting himself with respect to the toilet according to the size of the toddler by providing an adjustable platform that is suitable for the toddler to step upon and adjust his height relative to the toilet to facilitate control over the direction of his urine flow.

Various embodiments of the toilet training devices described herein enable toilet training without the addition of complicated mechanical devices attached to an adult toilet, making such embodiments particularly suitable for transportable applications because the device is relatively compact and light weight. In such embodiments, the device can be transported fully assembled as a platform or the device can be easily and quickly disassembled and reassembled to form the platform. In various embodiments, the operation of the device may be relatively simple and robust, and may enable toilet training without external mechanical devices or equipment attached to the toilet to adjust the toddler's height. In various embodiments, a toilet training device may be in the form of a consumable product, configured to be disposed after use, or may be in the form of a reusable product.

In various embodiments, accommodation of a wide variety of different shaped toilet bases or different bathroom fixtures may be accomplished using substantially the same device since virtually unlimited numbers of shapes of the interchangeable legs can be designed and used to meet the specific base of a particular bathroom fixture. For example, various embodiments of the device can be used by a toddler across a wide range of bathroom fixtures, such as a base of a toilet, a base of a sink or a base of a bathtub to adjust the height of the toddler during use of such bathroom fixtures.

An exemplary embodiment of a toilet training device 100 is illustrated in FIG. 1. The toilet training device 100 can include a base, such as, for example, a mat, a plate or a platform, having a body portion 102 that is substantially planar and provides a supporting structure. The body portion 102 may include a pair of laterally extending legs 104 that define a opening 106 that conforms to the base of a bathroom fixture, such as a base of a toilet 132 or a sink 136, as shown for example in FIGS. 3, 10, 11 and 12. Vertical walls 108 may extend from an upper surface 112 to a bottom surface 114 of the body portion 102 to form the thickness of the toilet training device 100.

Figure 2:
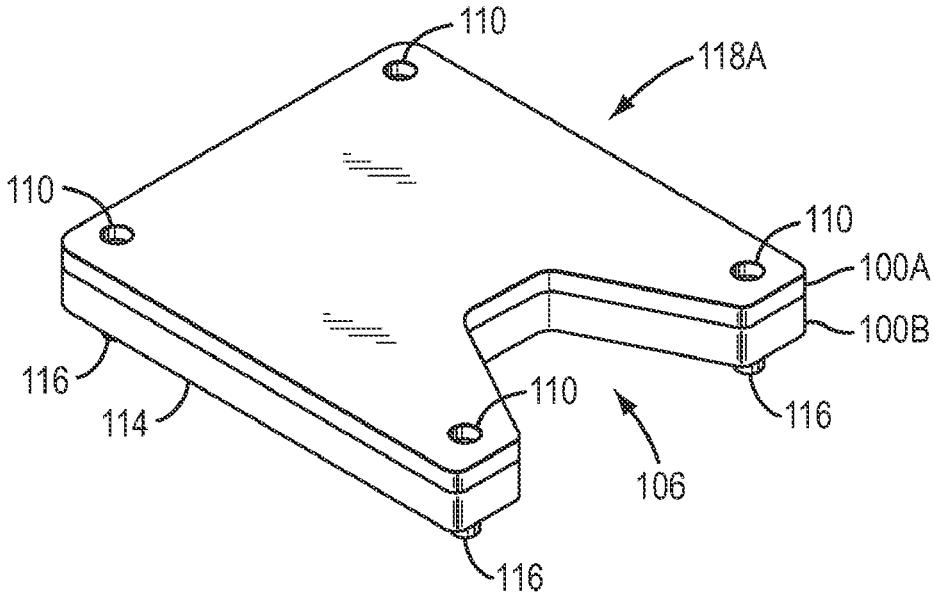
FIG. 2 is a perspective view and depicts an exemplary embodiment of a toilet training device in an interlocked and stacked configuration in accordance with the present teachings.

Various interlocking elements may be provided to stack and secure one toilet training device 100 on top of another toilet training device 100, in a stacked configuration shown as a raised platform 118A in FIG. 2. For example, the body portion 102 may have at least one opening 110 formed in its upper surface 112. At least one of the extending legs 104 may also have at least one opening 110 formed in the upper surface 112. The bottom surface 114 may have at least one projection 116 integrally projecting therefrom. Projection 116 may be aligned and mated with opening 110 to define an interlocking element so that at least two of the toilet training devices 100 can be interlocked and stacked one atop of the other to form a raised step, such as raised platform 118A and 118B, as shown, for example, in FIGS. 2 and 3. In this locked state, the toilet training devices 100 are latched and secured to each other to prevent shifting during use by a toddler.

In various embodiments, such as, for example, in the exemplary embodiments of FIGS. 1-3 and 8-12, the interlocking elements may be strategically positioned as projections 116 and openings 110 aligned along the outer edges of the toilet training device 100, 100A, 100B and 100C. In some embodiments, the interlocking elements may be a single mechanism or a plurality of mechanisms formed or attached at various locations of the toilet training device 100, 100A, 100B and 100C.

In lieu of or in addition to having an opening-and-projection interlocking element, the toilet training device 100, 100A, 100B, 100C and 100A may include any interlocking element, such as a hook and loop fastener, for example, Velcro™. Those having skill in the art would recognize various interlocking elements and/or configurations that may be used to stack and securely lock at least two of the toilet training devices 100 while providing a flat and secure surface for a toddler.

In general, the toilet training device 100 may be made of any material or a combination of materials suitable for providing a flexible structure that is sturdy enough to support the weight of a toddler or any user during use. The toilet training device 100 may be made of any type of organic, inorganic, thermoplastic or thermosetting material. In some embodiments, the toilet training device 100 may be formed by injection molding techniques from suitable plastic compounds which cure into a flexible material. For example, the toilet training device 100 can be made of polypropylene, polyethylene, vinyl, nylon, rubber, ethylene vinyl acetate (EVA) foam or any other material that can be molded or injection-molded in this fashion. The toilet training device 100 may be reusable and inexpensive to clean and sanitize. In various embodiments, the toilet training device 100 may be easily cleaned by, for example, merely wiping off the upper surface 112 or any other soiled portion of the device to remove any liquids or grime collected thereon.

Figure 3:
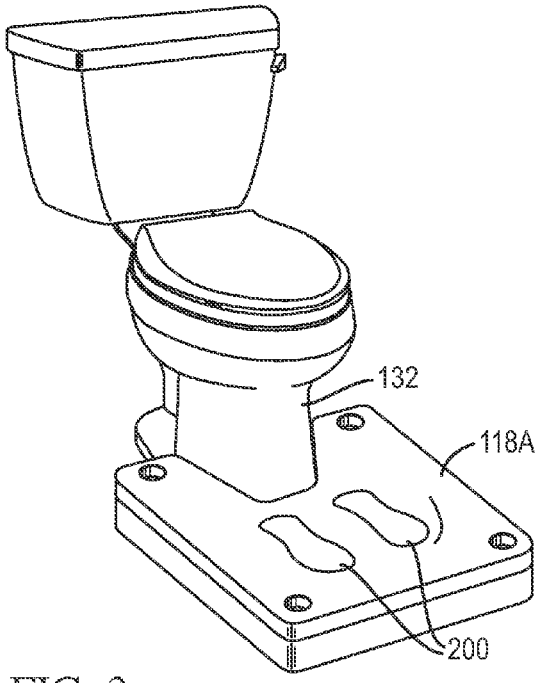
FIG. 3 is a perspective view of the device of FIG. 2 and depicts an exemplary embodiment in use with an adult toilet.
Figure 10:
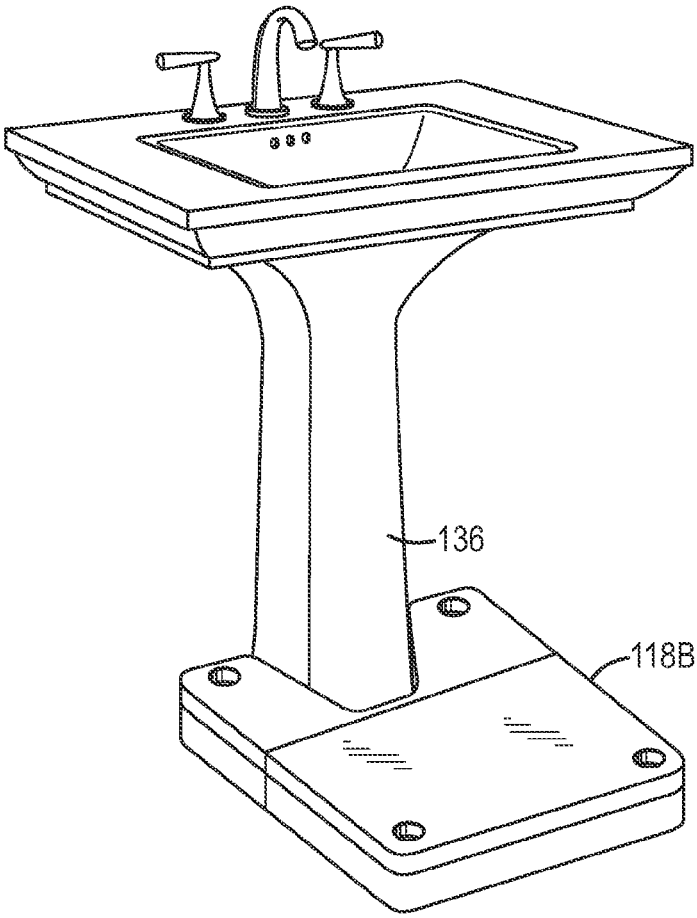
FIG. 10 is a perspective view of the device of FIG. 8 and depicts an exemplary embodiment in use with an adult pedal sink with the extendable legs in a retracted position.
Figure 11:
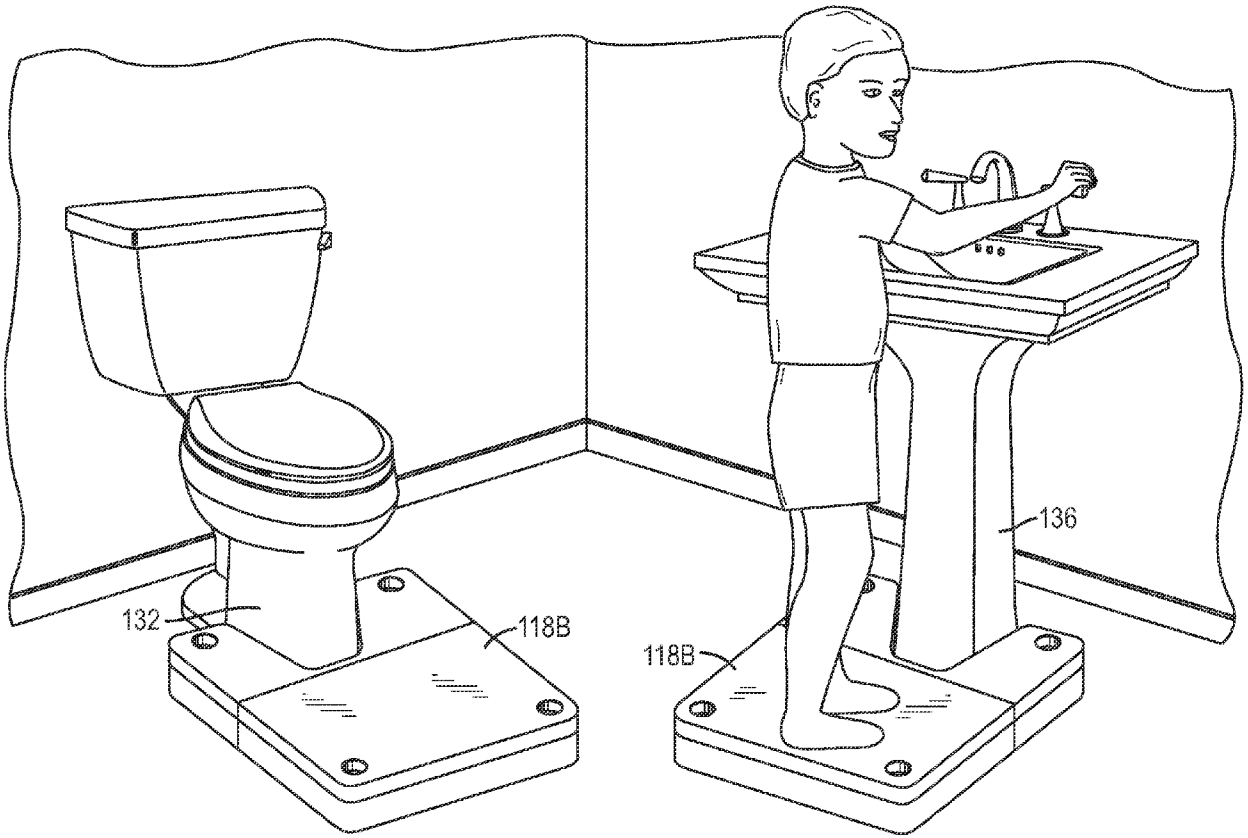
FIG. 11 illustrates various configurations of a toilet training device in accordance with the present teachings in use in a powder room.

The toilet training devices 100, 100A, 100B, and 100C can have a variety of configurations. The toilet training devices 100, 100A, 100B, and 100C are shown in FIGS. 1-3 and 5-12 as having a substantially U-shaped profile. It should be understood that the configurations of the individual toilet training devices 100, 100A, 100B, and 100C shown and described with reference to FIGS. 1-3 and 5-12 are nonlimiting and exemplary only. The toilet training device 100 may have peripheral surfaces including a opening 106 to define a configuration such as, for example, a partial square, a partial rectangular, a partial triangular, partial oval, partial semicircle, etc. to receive and securely conform to at least a portion of the base of a bathroom fixture. For example, in various embodiments, the toilet training devices 100, 100A, 100B, and 100C may receive and securely conform to the front and the side portions of the base of a toilet 132 (as shown in FIG. 3) or the base of a sink 136 (as shown in FIGS. 10 and 11). Those skilled in the art would understand that various sizes, shapes and configurations may be envisioned for the toilet training device 100 without departing from the scope of the present teachings.

In some embodiments, the opening 106 may be designed having a profile narrower or larger than the opening 106 shown in the exemplary embodiment depicted in FIGS. 1-3 and 5-12. In various embodiments, the opening 106 can be designed to fit toilet bases 132 of different sizes, heights and configurations, as shown, for example in FIGS. 4A-4F. The opening 106 may have a variety of configurations such that the device securely conforms to the base of a toilet 132 and provides a secure and comfortable platform for a toddler during toilet training. In various exemplary embodiments, the toilet training device 100 can be toilet specific such that the configuration of the opening 106 can be selected based upon the shape of the base of the toilet. In various embodiments, the opening 106 may be configured having a profile to conform to a toilet base 132 having an elongated configuration similar to, for example, the toilet bases 132 shown in FIGS. 4A, 4C and 4D. In other embodiments, the opening 106 may be configured having a profile to conform to a toilet base 132 having a column configuration similar to, for example, the toilet base 132 shown in FIG. 4B. In other embodiments, the opening 106 may be configured having a profile to conform to a toilet base 132 having a circular configuration similar to, for example, the toilet base 132 shown in FIG. 4E. In some embodiments, the opening may be configured having a profile to conform to a toilet base 132 having a tapering configuration similar to, for example, the toilet base 132 shown in FIG. 4F which is described in U.S. Design Pat. No. D496,444 issued to Kergoet.

Referring to FIGS. 1-3, 5 and 8-12, each toilet training devices 100, 100A, 100B, and 100C may be configured to have a variety of different shapes and dimensions. In various embodiments of the toilet training devices in the stacked configuration 118A and 118B, each toilet training device 100 can be configured to be symmetrical having substantially the same shape, thickness, and size. On the other hand, in other embodiments, the toilet training devices may be configured having different dimensions such as having different thicknesses. For example, as shown in FIG. 2, toilet training device 100B, which may serve as a base, can be twice as thick as toilet training device 100A. Thus several toilet training devices 100A may be stacked upon toilet training device 100B to serve as a platform to properly adjust the toddler's height. Any combination of toilet training devices 100A, 100B may be stacked to form platform 118A, 118B. The caregiver may stack as many toilet training devices 100A, 100B, as needed, to properly adjust the toddler's height. On the other hand, as the toddler grows taller and no longer needs as many stacked levels of the toilet training devices 100A, 100B, but the toddler still is not quite capable of fully reaching the adult bathroom fixture, the caregiver may remove any unnecessary toilet training devices 100A, 100B to maintain the toddler's proper height with respect to bathroom fixture.

In some embodiments, the thickness of the toilet training devices 100, 100A, 100B, and 100C can be approximately 1 inch to 5 inches. For example, in the exemplary embodiment shown in FIG. 2, the thickness of the toilet training device 100A can be approximately 1 inch to 2 inches, and the thickness of the toilet training device 100B can be approximately 2 inches to 4 inches. In some embodiments, the width of the toilet training devices 100, 100A, 100B, and 100C can be approximately 15 inches to 30 inches, such that the toilet training devices 100, 100A, 100B, and 100C provide a supporting surface that is sufficiently wide to permit a toddler to comfortably stand, maneuver upon the upper surface 112 during use and easily exit therefrom after use.

The bottom surface 114 may include a base made from a rubber-like, impermeable material, such as polyvinyl-chloride. The base of the bottom surface 114 may include a non-skid surface to retain the toilet training devices 100, 100A, 100B, and 100C in a fixed position relative to the floor or underlying surface. Several non-skid mechanisms have been identified to secure the bottom surface 114 to the floor: rubber skids, double-side adhesive strips, VELCRO™ and suction caps. All of these mechanisms, as well as others, can be used, as the above list is not an exclusive one.

In various embodiments, the non-skid mechanism may attach to or be an integral part of projections 116. Thus, in some embodiments, the bottom surface 112 may be configured with the non-skid projections 116, as shown, for example, in FIGS. 1, 2, 5, 6, 8, and 12. In other embodiments, the bottom surface 112 may be configured without projections extending therefrom such that the non-skid surface attaches directly to the underlying surface, as shown, for example, FIGS. 3, 9, 10, 11, and 12.

Figure 4A:
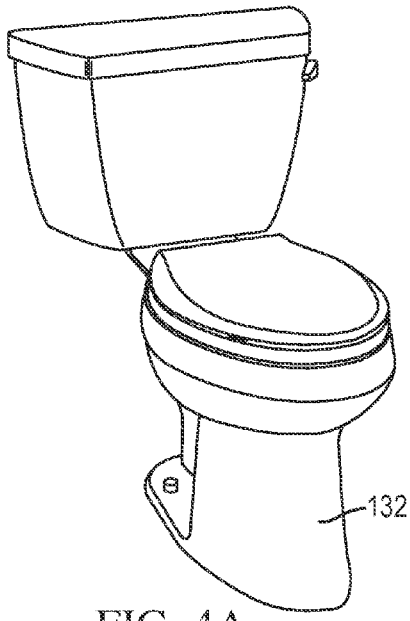
FIG. 4A is a perspective view of an adult toilet that can be used in conjunction with the toilet training device according to the present teachings.
Figure 4B:
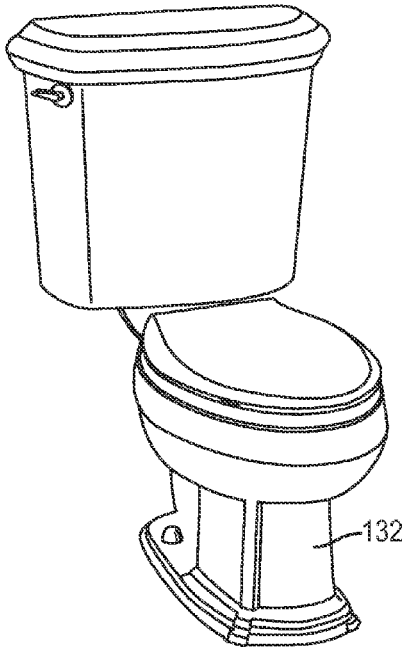
FIG. 4B is a perspective view of an adult toilet that can be used in conjunction with the toilet training device according to the present teachings.
Figure 4C:
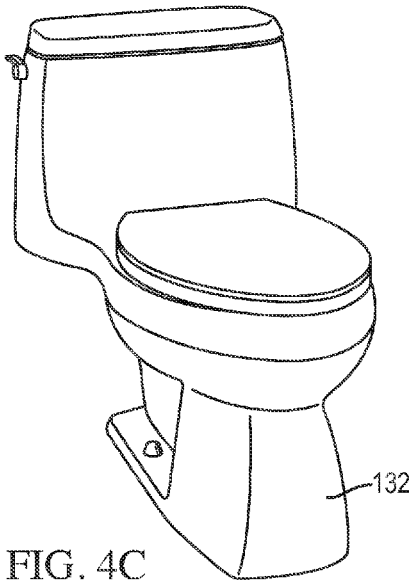
FIG. 4C is a perspective view of an adult toilet that can be used in conjunction with the toilet training device according to the present teachings.
Figure 4D:
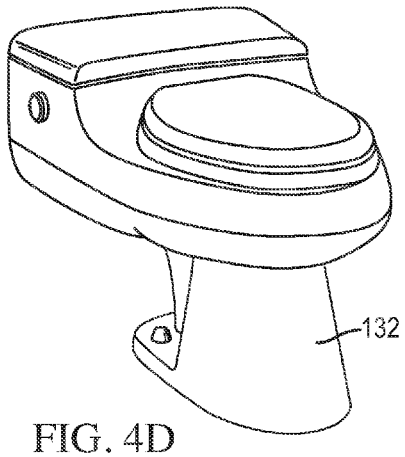
FIG. 4D is a perspective view of an adult toilet that can be used in conjunction with the toilet training device according to the present teachings.
Figure 4E:
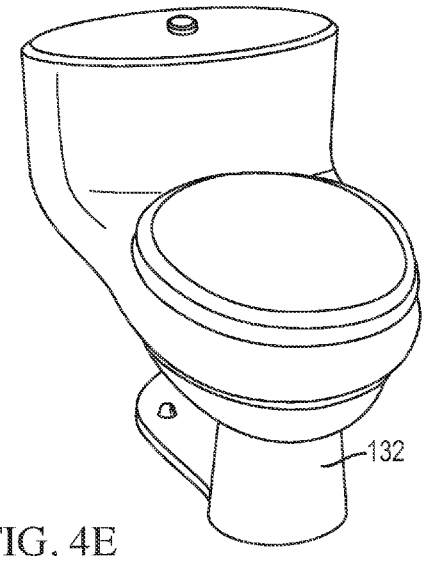
FIG. 4E is a perspective view of an adult toilet that can be used in conjunction with the toilet training device according to the present teachings.
Figure 4F:
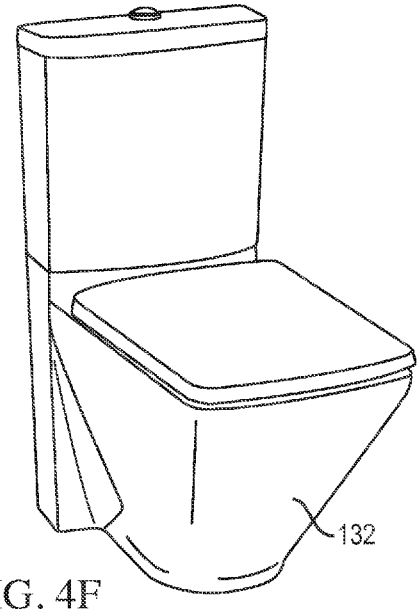
FIG. 4F is a perspective view of an adult toilet that can be used in conjunction with the toilet training device according to the present teachings.

In some embodiments, the toilet training device 100, 100A and 100B may be constructed as a single component, as shown in FIGS. 1-3. In other embodiments, the toilet training device 100C may be constructed as multiple components that connect together, examples of which are discussed in more detail below in reference to FIGS. 5-12. FIGS. 4A-4F depict embodiments of various toilet bases 132 that may be used in conjunction with the toilet training device 100, 100A, 100B and 100C either as a single component or as multiple components. FIG. 3 illustrates an exemplary embodiment of the toilet training device 100 as a single component in the stacked configuration 118A in use with a toilet base 132 having an elongated shape as shown in FIG. 4A.

Figure 12:
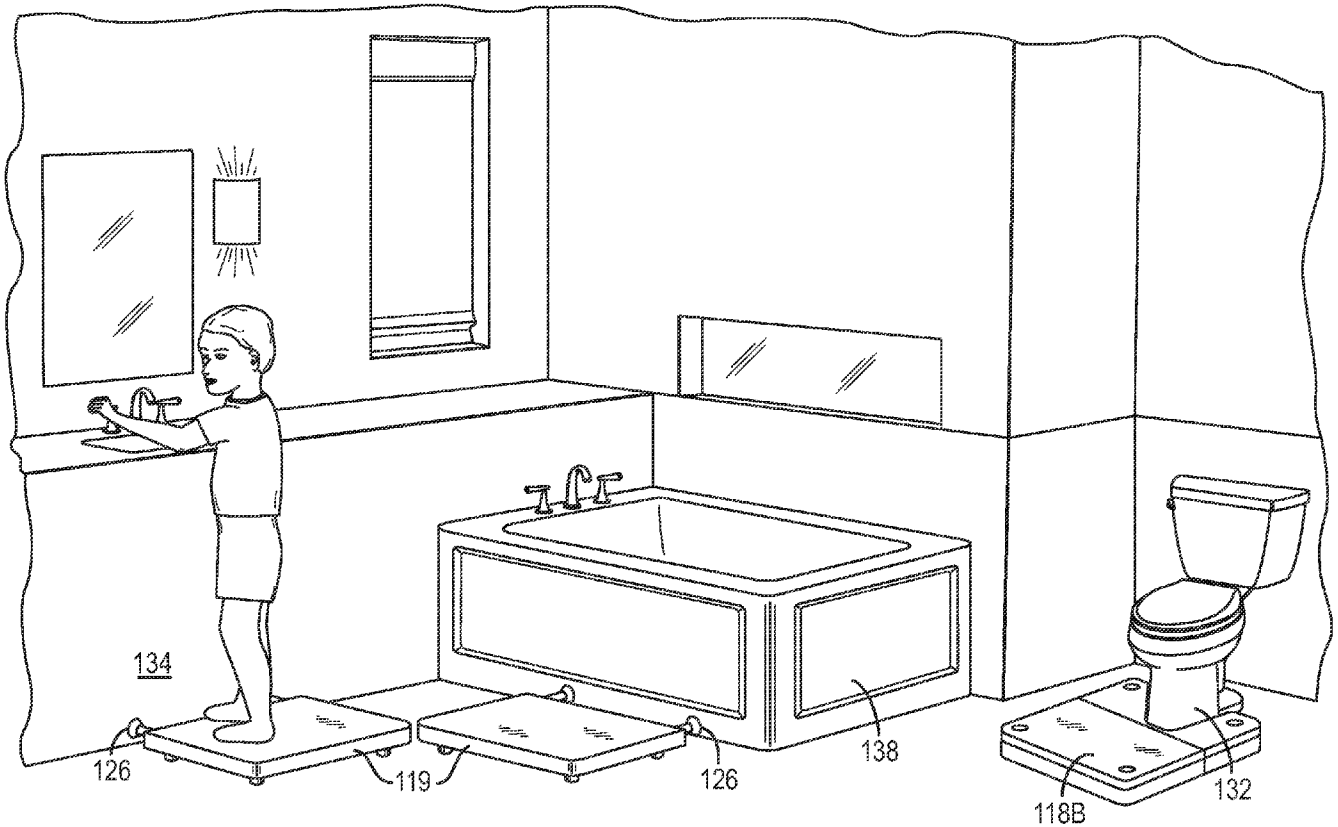
FIG. 12 illustrates various configurations of a toilet training device in accordance with the present teachings in use in a conventional bathroom.

In use, as shown in FIG. 3, the toilet training device 100 may be positioned such that the opening 106 of the body portion 102 receives and conforms to the base of the toilet such that the extending legs 104 straddle the base of the toilet 132. In some embodiments, the toilet training devices 100, 100A, 100B, and 100C may be made of rubber or a material having sufficient elasticity to stretch and to conform snugly to the base of the toilet 132 to provide a secure supporting structure without the attachment of bulky mechanical equipment. In addition, the toilet training device 100 may conform snugly to the base of the toilet 132 to capture any liquids that may flow down the base of the toilet 132. The opening 106 may include an inner ring or an inner liner (not shown) that serves to capture any liquids that travels from the rim of the toilet down the base of the toilet 132. In an alternate arrangement of FIG. 3, the toilet training device 100C constructed as multiple components can also be used in conjunction with the exemplary toilet base 132 shown in FIG. 3, for example, as shown in FIGS. 11 and 12.

In use, the toilet training device 100 may be used in a standing and/or seated position to facilitate toilet training A toddler may employ the toilet training devices 100, 100A, 100B, and 100C to help safely position himself or herself in a seated position on top of a toilet seat. In addition, when used in a seated position, the toilet training devices 100, 100A, 100B, and 100C can be easily converted to a portable and adjustable footrest to properly position both a female and a male toddler in the proper squatting position to facilitate a bowel movement. In some embodiments, the device may include proper foot positioning guides 200 for both male and female toddlers to encourage a bowel movement, while sitting on the toilet. The device can be adjusted based upon the user's height to establish the proper foot and knee orientation to facilitate bowel movement, similar to a squatting or semi-squatting position. In use, the toilet training device 100 may be used in a standing and/or seated position to facilitate toilet training. A toddler may employ the toilet training devices 100, 100A, 100B, and 100C to help safely position himself or herself in a seated position on top of a toilet seat. In addition, when used in a seated position, the toilet training devices 100, 100A, 100B, and 100C can be easily converted to a portable and adjustable footrest to properly position both a female and a male toddler in the proper squatting position to facilitate a bowel movement. In some embodiments, the device may include proper foot positioning guides 200 for both male and female toddlers to encourage a bowel movement, while sitting on the toilet. The device can be adjusted based upon the user's height to establish the proper foot and knee orientation to facilitate bowel movement, similar to a squatting or semi-squatting position.

When used in a standing position, a male toddler may employ the toilet training devices 100, 100A, 100B, and 100C to properly adjust his height to obtain the proper orientation of the flow of his urine. For instance, the toilet training device 100 can be easily converted to properly adjust the height of a male toddler to obtain the proper standing position to control his urine. The toilet training devices 100, 100A, 100B, and 100C may include foot positioning guides 200 for a male toddler for proper orientation during standing.

A caregiver may be responsible for toilet training a variety of toddlers of different ages, heights and genders. Thus, the optimum height may vary from toddler to toddler. Thus, a caregiver can vertically adjust the footrest to a predetermined position most advantageous for the toddler by selecting the proper combination of stackable toilet training devices 100 that corresponds to the user's characteristics, such as, for example, height, weight and age. Therefore, the toilet training device 100 may include a height guide or scale (not shown) printed on the device that represent the proper height, foot position or squatting orientation of potential users based, for example, on age, weight and height. In addition, the toilet training device may include entertainment, such as, for example, music, flashing lights or animated characters to entertain and encourage the toddler in the seated position and/or standing position.

Figure 5:
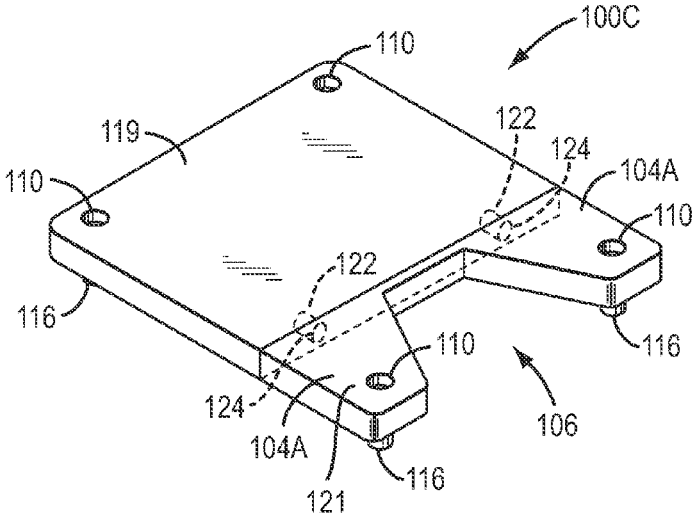
FIG. 5 is another exemplary embodiment of a toilet training device in accordance with the present teachings.
Figure 6A:
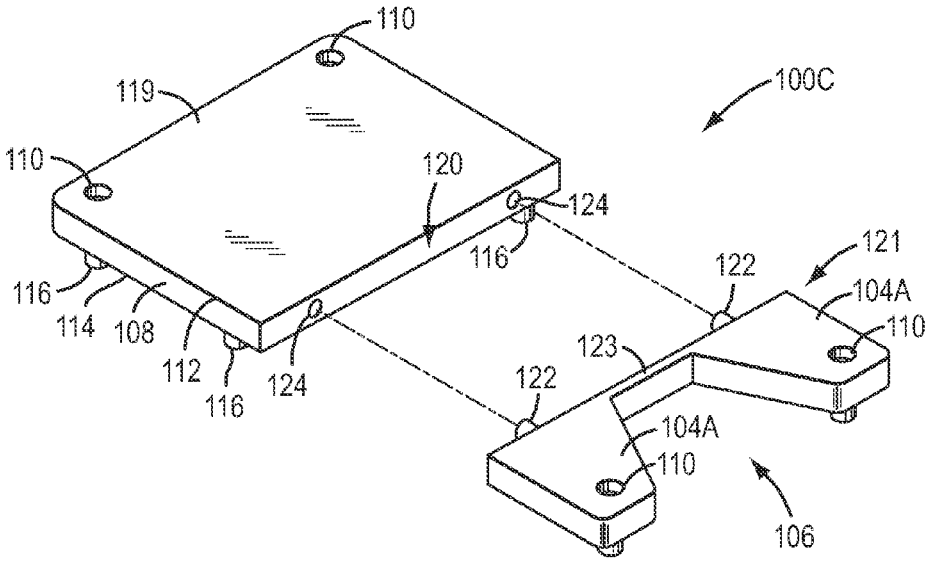
FIGS. 6A-6B illustrate a perspective view of FIG. 5 and depict an exemplary embodiment of a detachable supporting surface and a pair of detachable legs disconnected prior to assembly.

As mentioned above, in various exemplary embodiments as shown, for example, in FIGS. 5, 6 and 9-12, a toilet training device 100C may be constructed as multiple components that connect together by a fastening mechanism. Toilet training device 100C may be readily assembled and disassembled into two main components 119, 121, as shown in FIGS. 5 and 6. FIG. 6A illustrates the two main components 119, 121 of the toilet training device 110C disconnected, but just prior to assembly, as depicted in FIG. 5. The toilet training device 100C provides a simple and convenient device to facilitate and encourage toilet training in a toilet training mode and is easily disassembled and reassembled to assist a toddler when using a variety of bathroom fixtures within the same bathroom. In some embodiments, the toilet training device 100C may be assembled into a toilet training mode (FIGS. 11 and 12), a sink mode (FIGS. 9-12) or a bathtub mode (FIG. 12) for use among a variety of bathroom fixtures within a single bathroom.

The two main components of the toilet training device 100C may include a detachable supporting surface 119 and a detachable legs assembly 121 that connect together (FIG. 5). The detachable supporting surface 119 may include a body portion, similar to body portion 102 shown in FIG. 1, which is substantially planar and provides a supporting surface. The detachable supporting surface 119 may include at least one opening 110 formed in its upper surface 112. Vertical walls 108 may extend from the upper surface 112 to a bottom surface 114 to form the thickness of the detachable supporting surface 119. In some embodiments, vertical walls 108 may include a front edge 120 that is constructed substantially flat (FIG. 6A) and may include at least one opening 124 formed therein. Similar to FIGS. 1-2, the bottom surface 114 may have at least one projection 116 integrally projecting therefrom. Projection 116 may be aligned and mated with opening 110 to define an interlocking element so that at least two of the toilet training devices 100C can be interlocked and stacked one atop of the other to form a raised step, such as raised platform 118B, as shown, for example, in FIGS. 8-12. In this locked state, the toilet training devices 100C are latched and secured to each other to prevent shifting during use by a toddler or any other user.

As illustrated in FIG. 6A, in an exemplary embodiment, the detachable legs assembly 121 may include a pair of legs 104A and a connecting member 123 disposed near the top portion of the legs 104A to help maintain the legs 104A in at least one desired position. In some embodiments, the thickness of the connecting member 12 can be approximately 1 inch to 2 inches or any formation that will provide a generally sturdy relationship between the legs 104A, 104B, 104C and 104D and maintain the desired position.

Various fastening mechanisms may be provided to assemble and connect the detachable supporting surface 119 with the detachable legs assembly 121, for example, as shown in FIG. 5. In some embodiments, the connecting member 123 may have at least one projection 122 integrally projecting therefrom. Projection 122 may be aligned and mated with opening 124 to assemble the detachable supporting surface 119 with the detachable legs assembly 121 into a fixture attachment mode. In the fixture attachment mode, the detachable supporting surface 119 and the detachable legs assembly 121 are securely connected together such that the toilet training device 118B can securely conform to the base of a bathroom fixture to provide a raised platform 118B to a toddler or any other user.

FIG. 5 depicts the detachable legs assembly 121 attached to the detachable supporting surface 119. In order to attach the detachable legs assembly with the detachable supporting surface 119, opening 124 may include, for example, a biased spring (not shown) that permits the projection 122 to be fully inserted and securely locked into the opening 124.

In various embodiments, the detachable legs assembly 121 may be detached from the detachable supporting surface 119 by overcoming the force of the spring. In some embodiments, the caregiver may manually overcome the force of the spring by simultaneously twisting and pulling the projection 122 of the detachable legs assembly 121 from the opening 124 of the detachable supporting surface 119. In lieu of and in addition to, a release button (not shown) may be provided either within the detachable supporting surface 119 or along the detachable legs assembly 121 such that depression of the release button is sufficient to overcome the spring and detach the detachable legs assembly 121 from the detachable supporting surface 119. Those having skill in the art would understand, however, that other mechanisms, in combination or in lieu of a biased spring and/or release button may be employed for interlocking the projection 122 in the opening 124 of the detachable supporting surface 119.

Figure 6B:
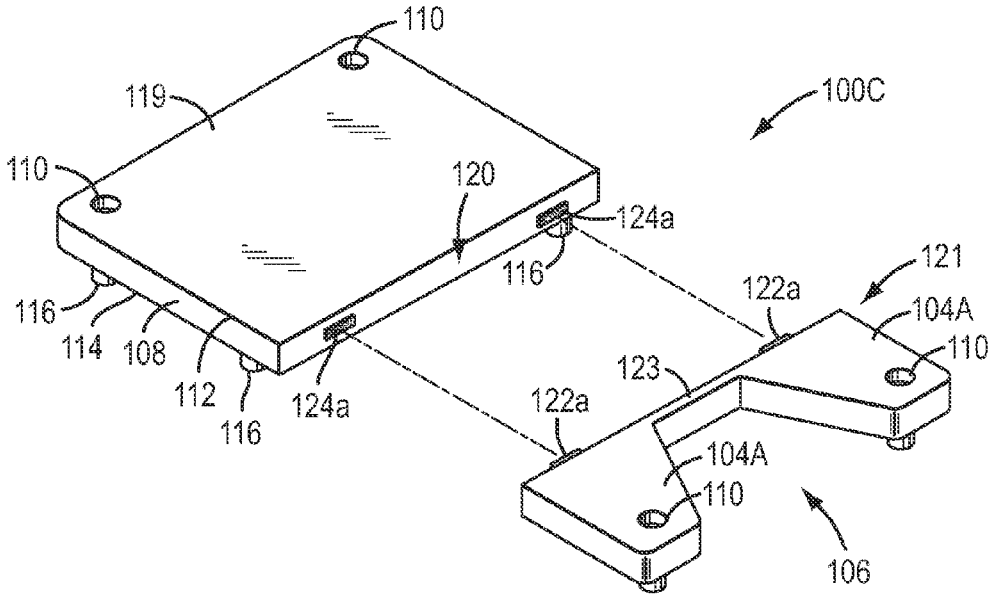

In lieu of or in addition to having an opening-and-projection fastening mechanism, the toilet training device 100C may include any fastening mechanism, such as a hook and loop fastener, 122*a*, 124*a*, for example, Velcro™, as shown in FIG. 6B. Those having skill in the art would recognize various fastening mechanisms and/or configurations that may be used to securely connect the detachable supporting surface 119 and the detachable legs assembly 121 while providing a flat and secure surface for a toddler or any other user.

In various embodiments, the detachable legs assembly 121 may be detachably connected to the detachable supporting surface 119 such that when the caregiver desires to collapse the toilet training device 118B for storage, the detachable legs assembly 121 is detached from the detachable supporting surface 119. In the detachable mode (FIGS. 6A-6B), the components may be stored as separate components, for example, in a suitcase and easily transported during travel with a toddler for use in a home, hotel, hospital or on family vacations. Thus, in this exemplary embodiment, the toilet training device provides a toddler with a compact and portable supporting surface that is readily assembled and dissembled by the toddler's caregiver.

In various exemplary embodiments, a toilet training device can be bathroom fixture specific such that the configuration of the detachable legs assembly 121 can be selected based upon the specific shape of the bathroom fixture to securely conform to the base of the bathroom fixture selected for use. Different bathrooms within an establishment, such as, for example a home, hotel or hospital may have a variety of bathroom fixtures, therefore needing a toilet training device and/or step stool capable of having different configurations to properly conform and connect to the base of the bathroom fixtures and to provide a secure platform for the toddler during use. Therefore, a toilet training device can be configured having several differing interchangeable detachable legs assembly 121 with differing configurations that can be connected to and disassembled from the detachable supporting surface 119. The same device can be used to provide a supporting surface for a toddler during use with a variety of bathroom fixtures (FIGS. 9-12).

In various embodiments, the connecting member 123 and the legs 104A may define substantially a U-shaped configuration 106. Detachable legs assembly 121 in accordance with various exemplary embodiments of the present teachings may be a configuration other than U-shaped, such as, for example, a partial circular, a partial square, a partial rectangular, a partial triangular, a partial oval, etc; the shape of the detachable legs assembly 121 is exemplary and nonlimiting.

One skilled in the art would appreciate that the detachable legs assembly 121 and the detachable supporting surface 119 may be constructed from either the same material or different materials with the suitable characteristics and configurations depending upon the intended use of the toilet training device. In various embodiments, the detachable legs assembly 121 may include only a single elongated leg or multiple elongated legs. In some embodiments, the legs 104A may be constructed as a single component or multiple components that are connected together. One skilled in the art would further appreciate that the legs 104A may be in pivotal engagement with connecting members 123 or detachable supporting surface 119 to be collapsible.

As shown in FIGS. 6A-6B, the detachable legs assembly 121 may be a uniform, solid body that is capable of connecting and mounting to a base of a toilet (FIG. 12) and a base of a sink, such as, for example, a pedal sink 136 (FIG. 10). In lieu of a uniform configuration, at least some of the legs 104 may have sizes, shapes, and other configurations that differ from each other.

Figure 8:
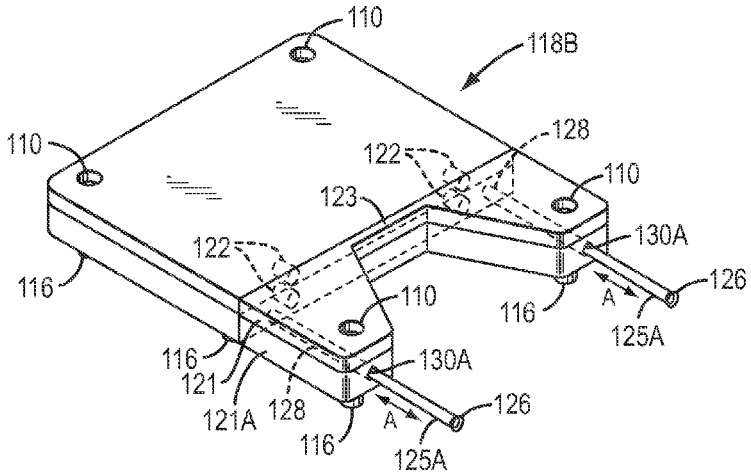
FIG. 8 is a perspective view and depicts another exemplary embodiment of a toilet training device in an interlocked and stacked configuration in accordance with the present teachings.
Figure 9:
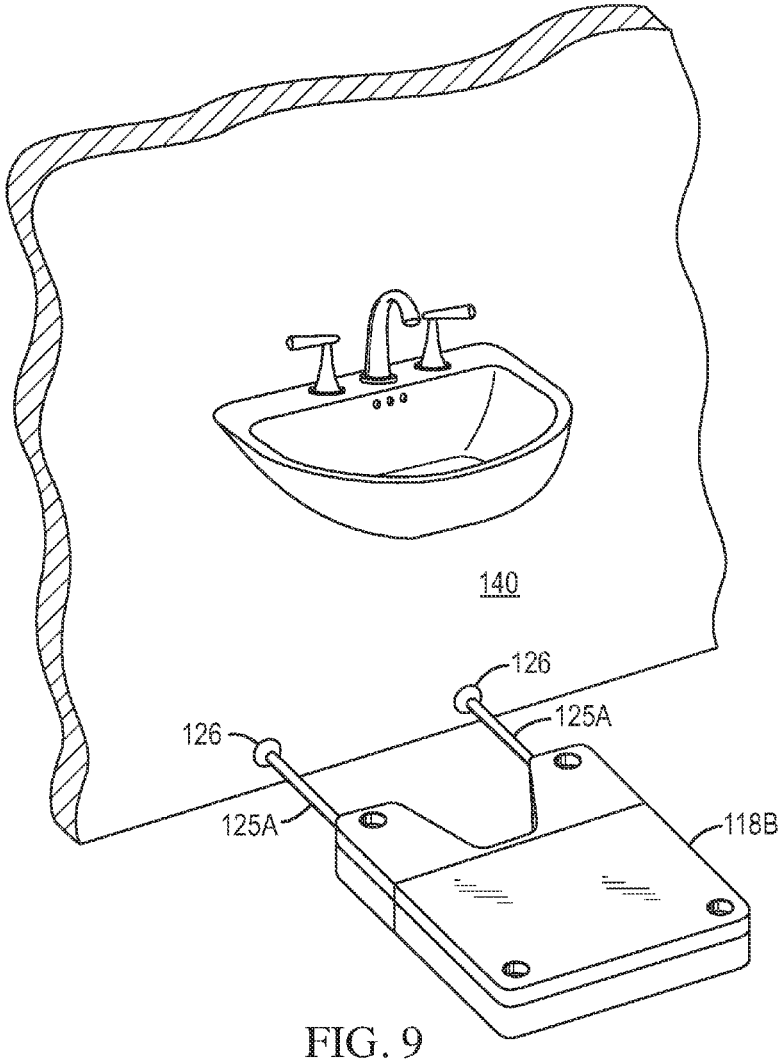
FIG. 9 is a perspective view of the device of FIG. 8 and depicts an exemplary embodiment in use with an adult wall-mounted sink.

In conjunction with being attachable to the base of a bathroom fixture, in some embodiments, the toilet training device may include an attaching mechanism that is capable of attaching to any opposing surface (FIGS. 8 and 9). In some embodiments, the toilet training device may be used to connect and conform to the base of a bathroom fixture and the attaching mechanism may also be employed. However, in other embodiments, the attaching mechanism may be employed as an independent means of securely attaching the toilet training device to another surface, such as, for example, an opposing wall 140 (FIG. 9). The attaching mechanism may be employed where the base of the bathroom fixture only extends partially downwardly, such as, for example, a partially extending vanity sink or where the bathroom fixture does not include a downwardly extending base that connects with the underlying surface, such as, for example, a wall-mounted sink 140 (FIG. 9).

Figure 7A:
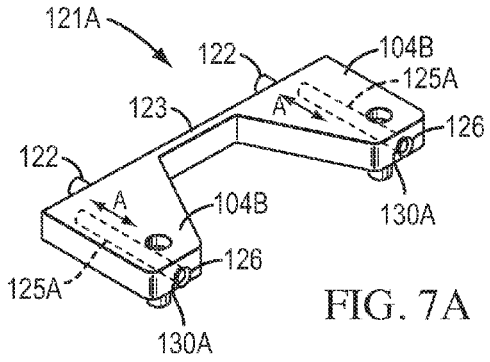
FIG. 7A is a perspective view of another exemplary embodiment of a pair of detachable legs.
Figure 7B:
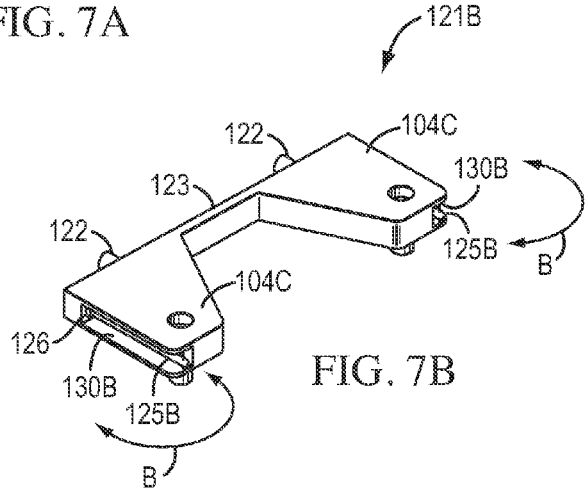
FIG. 7B is a perspective view of yet another exemplary embodiment of a pair of detachable legs.
Figure 7C:
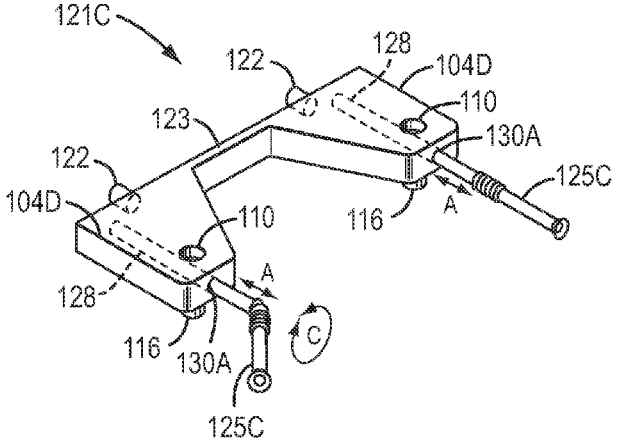
FIG. 7C is a perspective view of another exemplary embodiment of a pair of detachable legs.

FIGS. 7A-7C illustrate that legs 104B, 104C and 104D may include an attaching mechanism 125A, 125B and 125C inserted or included within openings 130A and 130B for extending between the detachable legs assembly 119 and securely attaching to an opposing surface. In various embodiments, the attaching mechanism may be at least one extendable or telescoping rod 125A, 125B, and 125C including a suction member 126 or other attaching mechanisms attached at an end of the rod. The rod may be tubular, square or round. Alternatively, the rod may be an extendable screw drive or any formation that will provide a generally rigid relationship with the detachable supporting surface 119 and the opposing surface. The detachable legs assembly 121A may include at least one bore, shown as track 128 (FIG. 8) in which rods 125A can be extracted from or retracted within (FIG. 7A). The horizontal extraction and retraction of rods 125A are depicted by arrow A in FIG. 7A.

As shown in FIG. 8, toilet training device 100C may be stacked on top of another toilet training device 100C, in a stacked configuration shown as a raised platform 118B. In the raised platform configuration, in various embodiments, each detachable supporting surface 119 and each detachable legs assembly 121 may be separate components that can be independently removed and/or interchanged. For example, in a bathroom having a partially extending vanity, the toilet training device may be reconfigured such that the attaching mechanism 125 is positioned at a higher level than the base level so that the device can attach to any portion of the partially extending surface. For example, in FIG. 8, the detachable legs assembly 121, which is shown as the top level shown and does not include an attaching mechanism, can be exchanged and replaced with detachable legs assembly 121A of the base level which includes the attaching mechanisms 125A. In FIGS. 7A, 7B and 7C in the embodiments that include multiple rods 125, each rod may be operated independently. In various embodiments of the device as a single component, the laterally extending legs 104 of the toilet training device of FIGS. 1-3 can be configured to employ the retractable and extendable attaching mechanism 125A, 125B and 125C of FIGS. 7A, 7B, and 7C.

FIGS. 7B and 7C illustrate exemplary embodiments in which the length and/or angle of the rods 125B and 125C may be independently adjustable to securely connect the detachable supporting surface 119 to a base of a bathroom fixture having an uneven configuration. For example, the rods 125B and 125C of the detachable supporting surface 119 may be unevenly adjusted to securely attach to, for example, a tub having a round configuration, a partially extending bathroom fixture or a base of a vanity sink having a receding sink configuration.

In FIG. 7B, rod 125B may be configured to rotate within the detachable legs assembly 121B about a perpendicular axis. The detachable legs assembly 121B, in FIG. 7B, includes an opening 130B extending along the slide of vertical wall 108 of the supporting legs assembly. The rod 125B may be hingedly connected to the detachable legs assembly 121B by a hinge or a pin (not shown), allowing rod 125B to swing in an arc as depicted by arrow B into and out from the detachable legs assembly 121. As previously discussed, in the embodiments including multiple rods, each rod 125B may be operated independently. Therefore, the toilet training device may be utilized even in small or confined spaces. For example, in some embodiments, only one of the rods may be needed to securely brace the device against an opposing surface. This single rod may be swung from opening 130B and securely mounted at any angle against the opposing surface.

FIG. 7C illustrates an exemplary embodiment of the present teachings that allows rod 125C of the detachable legs assembly 121C to be adjusted in all azimuths and swivels as depicted by arrow C. In addition to being extendable and retractable, rod 125C may include a bendable portion, with an accordion portion that has a plurality of annular grooves which permit the rod to be bent and remain in any direction. The rods 125C may be extended from openings 130A, rotated to the desired positioned and locked into position so that rods 125A remains in a rigid position relative to the detachable legs assembly 121C. The bendable portion may be made of any suitable metal or plastic that is capable of being repeatedly bent, or it may be made of multiple mechanical joints. Thus, the rods 125A, 125B and 125C can be either extracted from or swung out of the detachable legs assembly 121 such that the device can be adapted for use therewith without a particular space requirement.

In use, in the fixture attachment mode, as shown in FIGS. 8-12, the toilet training device can be converted for use with various bathroom fixtures. For example, in FIG. 9, the rods 125A may be extended to securely attach to an opposing wall 140 such that the toilet training device functions as a step stool. FIG. 10 illustrates that the toilet training device may be converted by retracting the rods 125A to conform to the base of a pedal sink 136 to facilitate hand washing. FIG. 11 illustrates that the same device may be easily converted for use with the base of a toilet 132 for toilet training and the base of a pedal sink 136 for hand washing. In various embodiments, rods 125A may be extended and attached to an opposing surface as the device is used to conform to the base of a bathroom fixture. FIG. 12 illustrates that the same device can be converted for use in the same bathroom in the fixture attachment mode and in the detached mode. In the fixture attachment mode, in FIG. 12, the toilet training device may be converted to conform to the base of a toilet 132.

In use, in the detached mode, as shown in FIGS. 6 and 12, the detachable supporting surface 119 may be converted for use as a step stool (FIG. 12) or a kneeler, separate from the detachable legs assembly 121. In such an embodiment, the front edge 120 (FIGS. 6A-6B) of the detachable supporting surface 119 may be constructed substantially flat such that, the front edge 119 may connect and conform to the base of a bathroom fixture such as, for example, a vanity sink 134 (FIG. 12) and a bathtub 138 (FIG. 12) to provide a safe and secure step stool for the toddler. In various embodiments, the toilet training device may be converted to serve as a step stool 119 for entry and exit during bathing (FIG. 12), as a step stool 119 for facilitating hand washing when using a sink, such as a vanity sink 134, as shown in FIG. 12 and/or as step stool for use with a urinal.

In the detached mode, an attaching mechanism, such as, for example, rod 125 including suction member 126, may be inserted or included within openings 124 (FIGS. 6 and 12) for extending between the detachable supporting surface 119 and securely attaching to an opposing surface, such as the base of a bathroom fixture, for example, the base of a bathtub 138 (FIG. 12) or the base of a vanity sink 134 (FIG. 12). For example, the attaching mechanism may be a rod, similar to rod 125, discussed in reference to FIGS. 7A-7C. The toilet training device may be constructed such that, when used in the detached mode (FIG. 6), the rods 125 of the detachable legs assembly 121 (FIGS. 7A-7C) may be removed from opening 130A and 130B and inserted for use in opening 124 of the detachable supporting surface 119 when it is used separately as a step stool (FIG. 12).

In various embodiments of the detached mode, the attaching mechanism may be at least one extendable or telescoping rod 125 having at least one suction member 126 (FIG. 12) or other attaching mechanisms attached at the end of the rod 125. The rods may be tubular, square or round. Alternatively, the rods may be an extendable screw drive or any formation that will provide a generally rigid relationship with the detachable supporting surface 119 and the opposing surface.

As previously discussed, in some embodiments which are also applicable to the detached mode, the length and/or angle of the rods 125 may be independently adjustable to securely connect the detachable supporting surface 119 to a base of a bathroom fixture having an uneven configuration. For example, the suction members 126 of the detachable supporting surface 119 may be unevenly adjusted to securely attach to, for example, a tub having a round configuration or a base of a vanity sink having a receding sink configuration.

The toilet training device 100 may have numerous other uses in other environments including around wash basins, inside bathtubs, showers, locker rooms, and the like where bacteria, odors and moisture are involved and the protection from slippage is of a concern. In addition for use by a toddler, the toilet training device may used by an elderly person, a disabled person or any person needing assistance in using a bathroom fixture.

The upper surface 112 can have a variety of configurations (e.g., designs, size, shape, etc.) such that the toilet training devices 100, 100A, 100B, and 100C provide a safe and comfortable platform for a toddler, as well as prevents the toddler from slipping from the upper surface and wherein the upper surface can be easily cleaned. In some embodiments, the upper surface 112 may be a flat surface made of an impervious material that forms a liquid barrier. Thus, the upper surface 112 can prevent fluids from penetrating through the individual toilet training device 100 and reaching the underlying surface or floor.

Alternatives to a flat upper surface 112 may include providing at least one channel or ridge (not shown) within the upper surface 112 to collect any liquid that falls on the top of the upper surface 112 to flow to the base of the upper surface 112. The channel or ridge permits the toddler to safely stand upon the upper surface 112 while any spilled liquid is directed from the top of the upper surface within the channel or ridges.

The channel or ridge may be configured to define an opening having an opening larger than the base of the channel or ridge to allow the liquids to easily collect or enter the channel or ridge. Likewise, the large opening enables the liquids to freely flow from the channel or ridge during cleaning of the toilet training device 100. To clean the toilet training device 100 and remove any liquids collected thereon, the adult caregiver may merely pour off the liquids from the upper surface and wipe off the surface.

The upper surface 112 may comprise a plurality of individual channels or ridges (not shown). The channels or ridges may be uniform, for example, having substantially the same size, shape or other characteristic features. In lieu of a uniform configuration, at least some of the channels or ridges may have sizes, shapes or other configurations that differ from each other. In some embodiments, the channels or ridges may extend from one edge to another edge across the upper surface 112. In some other embodiments, the channels or ridges may be formed to outline the perimeter of the upper surface 112 of the body portion 102.

In some embodiments, other configurations may be provided as the upper surface 112, for example, such as a grid design. The upper surface 112 may be made of a flexible sheet material having a screen or grid region to allow urine or other liquids to pass and collect within the base of the upper surface 112 until the toilet training device 100 is cleaned.

In various embodiments, the upper surface 112 may include an antibacterial agent and may further include an agent for eliminating odor and/or providing a pleasing fragrance. For instance, the upper surface 112 can be treated to prevent the growth of bacterial and germs. By way of example, MICROBAN™ can be applied to the toilet training device 100. In some embodiments, the upper surface 112 may be impregnated with deodorizing and disinfecting materials to neutralize or reduce any odor. In lieu of the deodorizing and disinfecting materials, the upper surface 112 may be made from an unscented flexible material.

Other embodiments of the disclosure will be apparent to those skilled in the art from consideration of the specification and practice of the teachings disclosed herein. It is intended that the specification and examples be considered as exemplary only.

What is claimed is:

1. A device for facilitating use of a bathroom fixture, the device comprising:

a planar body;

a detachable legs assembly extending from the planar body defining an opening;

a plurality of interchangeable attachment mechanisms; and at least one of the plurality of interchangeable attachment mechanisms extractable and retractable through at least one bore provided in the at least one detachable legs assembly, wherein the at least one attachment mechanism comprises a bendable portion dividing the at least one attachment mechanism into a longitudinal portion and a rotating end portion, wherein the longitudinal portion is extractable and retractable along a longitudinal axis from a first end of the at least one bore to a second end of the at least one bore, and wherein the bendable portion comprises an accordion portion having a plurality of annular grooves for bending and stretching the rotating end portion relative to the longitudinal portion, wherein the bendable portion allows the rotating end portion to rotate azimuthally when in an extracted position, and the at least one attachment mechanism is provided for securing the planar body to an opposing surface to prevent movement when the at least one attachment mechanism is in the extracted position.

2. The device of claim 1, further comprising:

a plurality of planar bodies;

a first planar body of the plurality of planar bodies having a first pair of opposed legs extending from the first planar body defining a first opening;

a second planar body of the plurality of planar bodies having a second pair of opposed legs extending from the second planar body defining a second opening;

an interlocking element interposed between at least the first planar body and the second planar body for interlocking and stacking at least the first and second planar bodies to form a raised platform adjustable to a predetermined height based upon a user's height for facilitating use of the bathroom fixture according to the user's height;

a skid-resistance bottom surface provided on at least one of the first planar body and second planar body for securing the raised platform to an underlying surface to prevent movement; and the at least one attachment mechanism extractable and retractable through the at least one bore provided in the at least one detachable legs assembly, the at least one attachment mechanism comprising the bendable portion that allows the rotating end portion of the at least one attachment mechanism to rotate azimuthally when in an extracted position, and the at least one attachment mechanism is provided for securing the raised platform to an opposing surface to prevent movement when the at least one attachment mechanism is in the extracted position.

3. The device of claim 2, wherein the first opening having a first configuration and the second opening having a second configuration.

4. The device of claim 2, wherein the interlocking element comprises at least one projection extending downwardly from at least one of the first planar body and the second planar body and at least one recess formed in at least one of the first and second planar bodies and wherein the at least one projection and the at least one recess mate to interlock and stack at least the first and second planar bodies together.

5. The device of claim 2, wherein the interlocking element comprises hook-and-loop fastening sections provided on at least one of the first planar body and the second planar body for interlocking and stacking at least the first and second planar bodies together.

6. The device of claim 2, wherein at least one of the first planar body and the second planar body comprises at least one of a flexible material and a thermoplastic material.

7. The device of claim 2, wherein at least one of the first planar body and the second planar body comprises a foot positioning guide to facilitate toilet training according to the user's height.

8. The device of claim 2, wherein at least the first and second planar bodies are interlockable and stackable such that the user is capable of assuming a squatting position and the raised platform serves as a footrest to facilitate a bowel movement.

9. The device of claim 2, wherein the at least one attachment mechanism comprises at least one of a horizontally extractable and retractable rod and a bendable rod.

10. A supporting surface for facilitating use of a bathroom fixture, said supporting surface comprising:

a planar body; and a detachable legs assembly extending from the planar body defining an opening for receiving and conforming to a configuration of a base of a bathroom fixture;

a first attachment mechanism extractable and retractable through a first bore and a second attachment mechanism extractable and retractable through a second bore, the first and second bores are provided in the detachable legs assembly, the first attachment mechanism and the second attachment mechanism are moveable parallel to each other; and the first attachment mechanism and the second attachment mechanism extends outwardly from the at least one detachable legs assembly for securing the planar body to an opposing surface to prevent movement; and at least one of the first attachment mechanism and the second attachment mechanism comprises a longitudinal portion connected to a rotating end portion by a bendable portion, wherein the longitudinal portion is extractable and retractable along a longitudinal axis from a first end to a second end of at least one of the first bore and the second bore, and wherein the bendable portion comprises an accordion portion having a plurality of annular grooves for bending and stretching the rotating end portion relative to the longitudinal portion when the rotating end portion is extracted from the at least one of the first bore and the second bore.

11. The supporting surface of claim 10, further comprising:

a plurality of planar bodies;

a first planar body of the plurality of planar bodies;

a second planar body of the plurality of planar bodies;

at least one detachable legs assembly extending from at least one of the first planar body and the second planar body defining at least one opening for receiving and conforming to the configuration of the base of the bathroom fixture;

an interlocking element interposed between at least the first planar body and the second planar body for interlocking and stacking together at least the first and second planar bodies for providing a supporting surface vertically adjustable to a predetermined height for facilitating use of the bathroom fixture; and a first attachment mechanism extractable and retractable through a first bore and a second attachment mechanism extractable and retractable through a second bore, the first and second bores are provided in the at least one detachable legs assembly, the first attachment mechanism and the second attachment mechanism are moveable parallel to each other; and the first attachment mechanism and the second attachment mechanism extends outwardly from the at least one detachable legs assembly for securing the supporting surface to an opposing surface to prevent movement.

12. The supporting surface of claim 11, further comprising:

the first planar body having a first detachable legs assembly including a first pair of opposing legs extending from the first planar body defining a first opening; and the second planar body having a second detachable legs assembly including a second pair of opposing legs extending from the second planar body defining a second opening.

13. The supporting surface of claim 12, wherein the first opening has a first configuration and the second opening has a second configuration.

14. A supporting surface for facilitating use of a bathroom fixture, said supporting surface comprising:

a planar body having at least one connection point;

a detachable legs assembly extending from the planar body for defining an opening for receiving and conforming to a configuration of a base of a bathroom fixture;

a plurality of interchangeable attachment mechanisms;

at least one of the plurality of interchangeable attachment mechanisms extractable and retractable through at least one bore provided in the at least one detachable legs assembly, wherein the at least one attachment mechanism comprises a bendable portion dividing the at least one attachment mechanism into a longitudinal portion and a rotating end portion, wherein the longitudinal portion is extractable and retractable along a longitudinal axis from a first end of the at least one bore to a second end of the least one bore, and wherein the bendable portion comprises an accordion portion having a plurality of annular grooves for bending and stretching the rotating end portion relative to the longitudinal portion when the rotating end portion is extracted from the at least one bore, and the at least one attachment mechanism is removable from the at least one bore provided in the detachable legs and interchangeably insertable into the at least one connection point provided in the planar body to attach the planar body to an opposing surface separate from the detachable legs assembly.

15. The supporting surface of claim 14, further comprising:

a plurality of planar bodies each having at least one connection point;

a first planar body of the plurality of planar bodies;

a second planar body of the plurality of planar bodies;

at least one detachable legs assembly extending from at least one of the planar bodies for defining at least one opening for receiving and conforming to the configuration of the base of the bathroom fixture;

at least one attachment mechanism extractable and retractable through at least one recess in the at least one detachable legs assembly;

an interlocking element interposed between the first planar body and the second planar body for interlocking and stacking together at least the first and second planar bodies for providing a supporting surface vertically adjustable to a predetermined height for facilitating use of the bathroom fixture; and the at least one attachment mechanism extractable and retractable through the at least one bore provided in the at least one detachable legs assembly, and the at least one attachment mechanism is removable from the at least one bore provided in the detachable legs and interchangeably insertable into the at least one connection point provided in the planar body to attach the planar body to an opposing surface separate from the detachable legs assembly.

16. The supporting surface of claim 14, wherein the at least one attachment mechanism comprises at least one rod.

17. The supporting surface of claim 14, wherein each of the attachment mechanism of the plurality of interchangeable attachment mechanisms is independently extractable and retractable.

18. A supporting surface for facilitating use of a bathroom fixture, and supporting surface comprising:

a planar body;

a detachable legs assembly extending from the planar body for defining an opening;

at least one attachment mechanism extractable and retractable through at least one bore in the at least one detachable legs assembly providing attachment to an opposing surface;

the at least one attachment mechanism having an articulation joint that is extractable and retractable and rotates azimuthally in an extracted position, wherein the articulated joint divides the at least one attachment mechanism into a longitudinal portion and a rotating end portion, wherein the longitudinal portion is extractable and retractable along a longitudinal axis from a first end of the at least one bore to a second end of the at least one bore, and wherein the articulated joint comprises an accordion portion having a plurality of annular grooves for bending and stretching the rotating end portion relative to the longitudinal portion when the rotating end is extracted from the at least one bore.

19. The supporting surface of claim 14, further comprising a detachable step stool configuration, wherein the planar body is detachable from the detachable legs assembly to provide a step stool and wherein the at least one attachment mechanism is removable from the at least one recess of the detachable legs assembly and insertable into at least one connection point provided in the planar body to attach the step stool to an opposing surface.

20. A kit for assembling a supporting surface to facilitate use of a bathroom fixture, the kit comprising:

a plurality of planar bodies each having at least one connection point;

a first planar body of the plurality of planar bodies;

a second planar body of the plurality of planar bodies;

a plurality of attachment mechanisms;

at least one detachable legs assembly extending from at least one of the first planar body and the second planar body defining at least one opening for receiving and conforming to a configuration of a base of a bathroom fixture;

at least one attachment mechanism of the plurality of attachment mechanisms extractable and retractable through at least one bore provided in the at least one detachable legs assembly;

the at least one attachment mechanism comprises a bendable portion dividing the at least one attachment mechanism into a longitudinal portion and a rotating end portion, wherein the longitudinal portion is extractable and retractable along a longitudinal axis from a first end of the at least one bore to a second end of the at least one bore, and wherein the bendable portion comprises an accordion portion having a plurality of annular grooves for bending and stretching the rotating end portion relative to the longitudinal portion when the rotating end is extracted from the at least one bore;

an interlocking element interposed between at least the first planar body and the second planar body for interlocking and stacking together at least the first and second planar bodies for providing a supporting surface vertically adjustable to a predetermined height for facilitating use of the bathroom fixture; and a detachable step stool configuration, wherein at least one planar body is detachable from the detachable legs assembly to provide a step stool and wherein the at least one attachment mechanism is removable from the at least one bore of the detachable legs assembly and interchangeably insertable into the at least one connection point provided in the at least one planar body to attach the step stool to an opposing surface.

21. A method of providing an adjustable supporting surface to facilitate use of a bathroom fixture, the method comprising:

providing a plurality of planar bodies each having at least one connection point;

providing a first planar body;

providing a second planar body;

providing a plurality of attachment mechanisms;

providing a detachable legs assembly attachable to and detachable from at least one of the first planar body and the second planar body, wherein the detachable legs assembly defines at least one opening for receiving and conforming to a configuration of a base of a bathroom fixture;

providing at least one attachment mechanism of the plurality of attachment mechanisms extractable and retractable through at least one bore provided in the at least one detachable legs assembly, wherein the at least one attachment mechanism comprises a bendable portion dividing the at least one attachment mechanism into a longitudinal portion and a rotating end portion, wherein the longitudinal portion is extractable and retractable along a longitudinal axis from a first end of the at least one bore to a second end of the at least one bore, and wherein the bendable portion comprises an accordion portion having a plurality of annular grooves for bending and stretching the rotating end portion relative to the longitudinal portion when the rotating end portion is extracted from the at least one bore;

interlocking and stacking at least the first planar body with the second planar body to provide a raised supporting surface;

positioning the interlocked and stacked raised supporting surface such that the at least one opening receives and conforms to the configuration of the base of the bathroom fixture to facilitate use of the bathroom fixture; and a detachable step stool configuration, wherein at least one planar body is detachable from the detachable legs assembly to provide a step stool and wherein the at least one attachment mechanism is removable from the at least one bore of the detachable legs assembly and interchangeably insertable into at least one connection point provided in the at least one planar body to attach the step stool to an opposing surface.

* * * * *